United States Patent [19]

Vicino et al.

[11] 4,416,073

[45] Nov. 22, 1983

[54] WATER-BORNE INFLATABLE PROMOTIONAL DEVICE

[75] Inventors: Robert K. Vicino; Mark S. Bachman, both of San Diego, Calif.

[73] Assignee: Robert Keith & Co., Inc., San Diego, Calif.

[21] Appl. No.: 365,128

[22] Filed: Apr. 5, 1982

[51] Int. Cl.[3] ..... G09F 19/00

[52] U.S. Cl. ..... 40/326; 40/214; 40/215; 40/538

[58] Field of Search ..... 40/538, 214, 215, 326; 114/242, 197

[56] References Cited

U.S. PATENT DOCUMENTS

| | | | |
|---|---|---|---|
| 803,084 | 10/1905 | Alexander | 40/326 |
| 1,332,274 | 3/1920 | Schlup | 40/326 |
| 1,677,450 | 7/1928 | Iden | 40/326 |
| 3,670,440 | 6/1972 | Yost | 40/215 |
| 4,019,454 | 4/1977 | Landwerlen | 114/197 |
| 4,178,706 | 12/1979 | Boyce | 40/326 |
| 4,217,846 | 8/1980 | Wight | 114/197 |

OTHER PUBLICATIONS

Article Titled "Patented Sea-Serpents" in Star Magazine of the Sunday Star of Apr. 22, 1906.

*Primary Examiner*—Gene Mancene
*Assistant Examiner*—Wenceslao J. Contreras
*Attorney, Agent, or Firm*—Charmasson & Holz

[57] ABSTRACT

An inflatable display is adapted to be towed over the surface of a body of water and includes an inflatable body which in the disclosed embodiment has an elongated ballast along the bottom to provide a keel-like structure and a blower to continuously force air into the body to keep it inflated against the slight deflation that continuously occurs at seam lines, etc. A tether is extended from the body to a tow vehicle so that the float can be towed along lake surfaces, bays and beach fronts for promotional purposes.

2 Claims, 8 Drawing Figures

WATER-BORNE INFLATABLE PROMOTIONAL DEVICE

BACKGROUND OF THE INVENTION

The inventor of the instant invention has become a master at the creation of inflatable promotional displays, including inflatable protrusions from conventional billboards, entire billboards which inflate, thirty-foot stand-up whiskey bottles and beer cans for promotions, and generally speaking any inflatable, particularly any giant inflated replica of a product.

By so moving flat advertising copy into the third dimension, the inventor has been a phenomenon in the outdoor advertising and promotional business. Although certain of the three-dimensional billboards created by the inventor have had motion components, the inventor now wants to move completely into the fourth dimension by the creation of gigantic inflated product replicas designed to be towed on water surfaces before large crowds of people, such as at beaches in the summertime and on resort lakes in the interior of the country.

SUMMARY OF THE INVENTION

The present invention fulfills these goals after a considerable amount of experimentation. Although adapted to various types of products, the product disclosed herein is a simulated beer bottle twenty to thirty feet long and eight to twelve feet in diameter. The beer bottle is fabricated of several different panels sewn together, and a series of compartments along the interior of one side of the bottle will hold ten pound weights to establish that side as the functional bottom of the inflated body, there being a blower mounted in a top portion to continuously pump air into the float establishing a slightly higher pressure to replace air lost through seams and other orifices.

A tether or tow rope structure includes a nylon rope and power cable extending from the tow vehicle back toward the float, where it connects to a rope yoke the ends of which extend through the cap of the beer bottle, and fasten to fabric patches bonded to the interior of the inflated body.

DETAILED DESCRIPTION OF THE PREFERRED EMBODIMENT

Figures 1, 2, 3, 4, 5, 6, 7, 8:
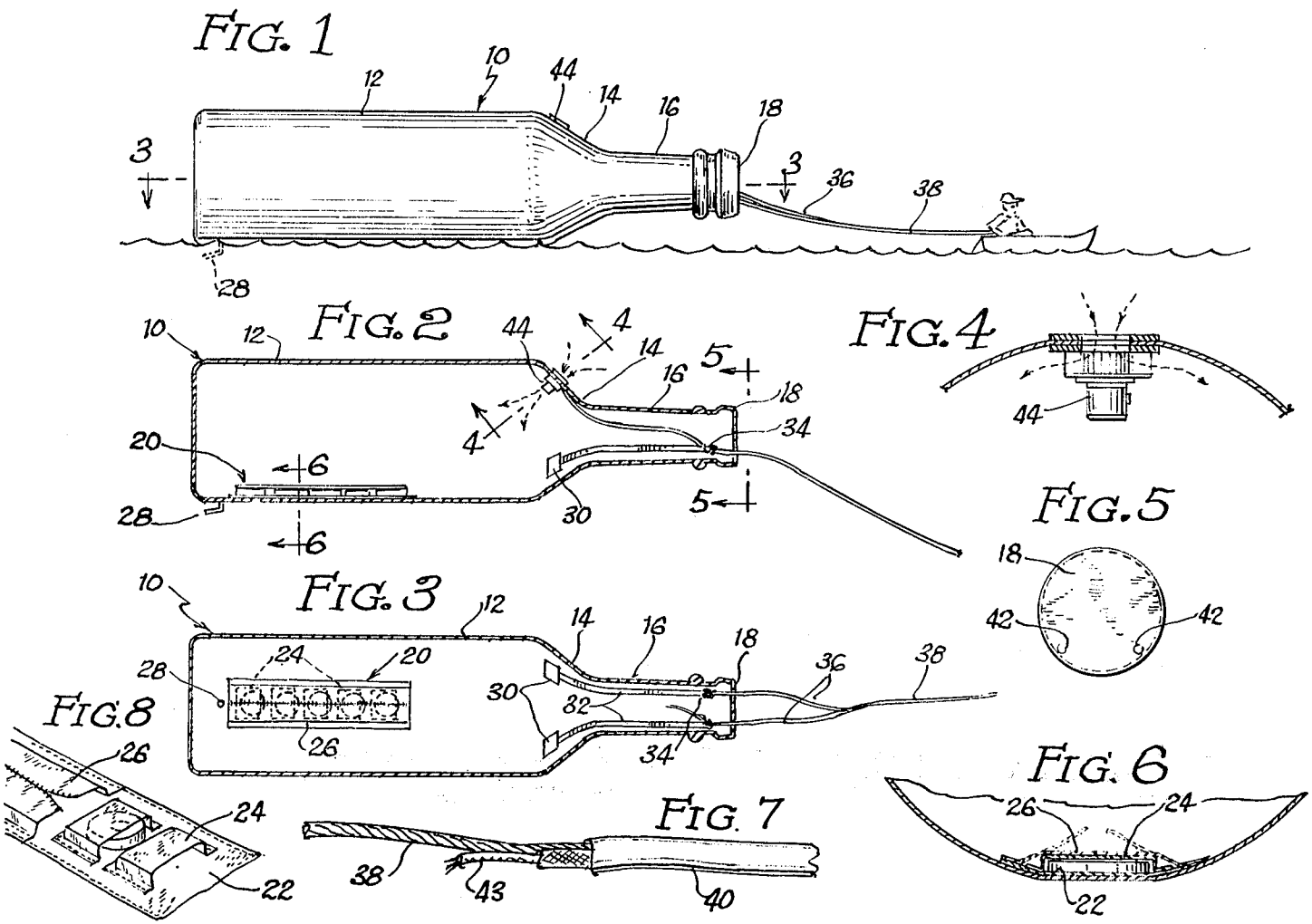
FIG. 1 is a side elevation view of the float being towed.
FIG. 2 is a vertical section taken through the float oriented as in FIG. 1.
FIG. 3 is a horizontal section taken through the float looking down.
FIG. 4 is a section taken along line 4—4 of FIG. 2.
FIG. 5 is a section view taken along line 5—5 of FIG. 2.
FIG. 6 is a section taken along line 6—6 of FIG. 2.
FIG. 7 is a detail illustrating the tow rope, cable and sheath construction; and, FIG. 8 is a perspective detail illustrating the manner in which the ballast weights are maintained in position.

The body of the float is indicated at 10, the float in the drawings representing a gigantic beer bottle having a cylindrical sidewall 12, sloping shoulders 14, tapering into a neck 16 and terminating in a simulated cap 18. This beer bottle body is constituted by an inflatable envelope constructed from a series of segments or panels of fabric sewn together.

In order to maintain the float in a upright position, a keel or ballast structure 20 is sewn along the interior bottom of the bottle. This structure includes a base panel 22, a series of pockets 24 sewn to the base panel, and a zippered cover 26 so that the weights are more or less maintained in position by the pockets 24, and are positively enclosed by operation of the zippered panel 26.

The base panel 22 is sewn around its perimeter to the bottom of the bottle as shown in FIG. 3, so that the bottle's normal resting position in the water is with its neck tilted slightly upwardly, inasmuch as the ballast is slightly aft of the center of buoyancy of the bottle.

Just aft of the ballast weights is a venturi drain tube 28 which by action of a flap check valve drains water which leaks into the bottle when the bottle is being towed.

A pair of tough reinforcing patches 30 attached at selected locations within the bottle-shaped envelope made of Nylon or the like serve as mounting points for tether straps 32 each of which is tied at 34 to a respective tow rope 36 of nylon or the like looped and engaged at its center by forward tow rope 38.

The nylon tow ropes as indicated in FIG. 7 are covered with a waterproof outer sheath 40 which also serves to minimize friction of the tow rope 36 as it passes through the holes 42 in the cap 18. In addition to shielding the tow rope, the sheath also contains the power and control wires 43 in one branch to control a two-speed motor 44. At low speed, this motor is operated by battery power from the towing craft to maintain a slight pressure inside the bottle sufficient to maintain its shape despite despite the continued low-level leakage through seams and other only partially closed orifices.

The high speed of the motor is used to inflate the bottle from a more powerful source of electricity on shore. Once inflated, a relatively small power level is required to maintain pressure within the body of the unit.

Although a beer bottle is shown, clearly the invention is adapted for use displaying virtually any kind of product which is three dimensional and lends itself to being simulated by a giant inflatable. By incorporating weights to define a keel and prevent rotation and proper tether mounts, a variety of different simulated products can be promoted by towing them across any body of water.

While the preferred embodiment of the invention has been described, other modifications may be made thereto and other embodiments may be devised within the spirit of the invention and scope of the appended claims.

What is claimed is:

1. A floating display comprising:

an inflatable envelope made of a plurality of fabric panels sewn together along permeable seams;

said panels being shaped and dimensioned so that the envelope when inflated assumes the enlarged shape of a product;

a blower mounted in one of said panels, said blower being directed to continuously introduce into said envelope a sufficient flow of ambient air to maintain said envelope inflated;

at least one pocket within said envelope;

ballast means within said pocket to keep said inflated envelope in a generally stable position when towed over a body of water;

a bailing tube in the lower portion of said envelope to evacuate fluid out of said envelope;

within said envelope, a plurality of anchoring patches attached at selected locatons to said sections;

a plurality of tethers, each having one end connected to one of said patches; the other ends of said tethers joining together to form a towing line;

said towing line exiting said envelope through an orifice in the envelope for attachment to a towing device.

2. The display claimed in claim 1 which further comprises:

a two-speed motor driving said blower, the higher speed being capable of rapidly inflating said envelope and the lower speed being sufficient to maintain said envelope in an inflated state by compensating for air losses through said permeable seams, said orifice and said bailing tube.

* * * * *